US009728027B2

(12) United States Patent
Obara

(10) Patent No.: US 9,728,027 B2
(45) Date of Patent: Aug. 8, 2017

(54) BANKNOTE PROCESSING APPARATUS AND BANKNOTE PROCESSING METHOD

(71) Applicant: Oki Electric Industry Co., Ltd., Tokyo (JP)

(72) Inventor: Tsukasa Obara, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/907,131

(22) PCT Filed: Apr. 24, 2014

(86) PCT No.: PCT/JP2014/061613
§ 371 (c)(1),
(2) Date: Jan. 22, 2016

(87) PCT Pub. No.: WO2015/029497
PCT Pub. Date: Mar. 5, 2015

(65) Prior Publication Data

US 2016/0180627 A1 Jun. 23, 2016

(30) Foreign Application Priority Data

Aug. 29, 2013 (JP) ..... 2013-178432

(51) Int. Cl.
*G07D 11/00* (2006.01)

(52) U.S. Cl.
CPC ..... *G07D 11/0066* (2013.01)

(58) Field of Classification Search
USPC ..... 235/375, 379; 705/43
See application file for complete search history.

(56) References Cited

U.S. PATENT DOCUMENTS 4,709,914 A 12/1987 Taylor
5,012,075 A * 4/1991 Hutchison ..... G07D 11/0009 109/43
2003/0121970 A1* 7/2003 Force ..... B65H 3/047 235/379

(Continued)

FOREIGN PATENT DOCUMENTS

JP H04-37980 A 2/1992
JP 2005-092421 A 4/2005

(Continued)

*Primary Examiner* — Allyson Trail
(74) *Attorney, Agent, or Firm* — Rabin & Berdo, P.C.

(57) ABSTRACT

A banknote processing apparatus including: one or more banknote storage boxes that store banknotes; an information management section that manages banknote management information including identification information for banknotes respectively stored in the one or more banknote storage boxes; a search information receiving section that receives input of search information including part of, or all of, identification information of a banknote to be searched for; a banknote search section that searches for a banknote matching the search information based on information being managed by the information management section; and a payout controller that effects control of feeding out and dispensing a detected banknote that has been detected by the banknote search section from the banknote storage boxes.

6 Claims, 12 Drawing Sheets

(56) References Cited

U.S. PATENT DOCUMENTS

| | | | | |
|---|---|---|---|---|
| 2004/0153408 | A1* | 8/2004 | Jones | G06Q 20/042 705/43 |
| 2004/0260650 | A1* | 12/2004 | Nagaya | G06Q 20/1085 705/43 |
| 2005/0056519 | A1 | 3/2005 | Yokoi et al. | |
| 2007/0176005 | A1 | 8/2007 | Sakoguchi | |
| 2010/0090397 | A1* | 4/2010 | Taniguchi | B65H 29/58 271/303 |
| 2010/0131407 | A1* | 5/2010 | Folk | G06Q 20/10 705/39 |
| 2011/0129139 | A1* | 6/2011 | Numata | G07D 7/0006 382/137 |
| 2011/0172808 | A1* | 7/2011 | Fu | G07D 11/0066 700/215 |
| 2011/0209966 | A1* | 9/2011 | Graef | G06Q 40/00 194/302 |
| 2011/0315760 | A1* | 12/2011 | Ito | G07D 11/0021 235/375 |
| 2012/0173013 | A1* | 7/2012 | Nakamoto | G07D 11/0084 700/215 |
| 2013/0046407 | A1 | 2/2013 | Tomizawa et al. | |
| 2013/0248320 | A1 | 9/2013 | Tomizawa | |
| 2014/0083814 | A1* | 3/2014 | Nomura | G07D 11/0027 194/206 |

FOREIGN PATENT DOCUMENTS

| | | | |
|---|---|---|---|
| JP | 2007-200149 | A | 8/2007 |
| JP | 2007-219817 | A | 8/2007 |
| JP | 2012-018534 | A | 1/2012 |
| JP | 2012-208828 | A | 10/2012 |
| JP | 2013-041425 | A | 2/2013 |
| WO | WO 2012-132496 | A1 | 10/2012 |

* cited by examiner

FIG.3

| STORAGE POSITION | DENOMINATION | SERIAL NUMBER | SERIAL NUMBER IMAGE |
|---|---|---|---|
| 1 | 10,000 YEN BANKNOTE | DD6423666 | IMAGE G001 |
| 2 | 10,000 YEN BANKNOTE | OD6423666 | IMAGE G002 |
| 3 | 10,000 YEN BANKNOTE | DU6423666 | IMAGE G003 |
| ... | ... | ... | |
| 40 | 10,000 YEN BANKNOTE | DD00000040 | IMAGE G040 |

BANKNOTE PROCESSING APPARATUS AND BANKNOTE PROCESSING METHOD

TECHNICAL FIELD

The present application claims priority from Japanese Patent Application No. 2013-178432, filed on the 29 of Aug. 2013, the disclosure of which is incorporated by reference herein in its entirety.

The present invention relates to a banknote processing apparatus and a banknote processing method, and is applicable, for example, to an automated teller machine (ATM) installed in a financial institution, such as a bank, in a convenience store, or the like.

BACKGROUND ART

There are existing ATMs installed with banknote processing apparatuses capable of managing banknotes inside storage boxes that store banknotes. Examples of existing banknote processing apparatuses equipped with means for managing banknotes are mentioned in the following publications.

Japanese Patent Application Laid-open (JP-A) No. 2007-219817 describes a banknote processing apparatus that confirms identification information printed (formed) on banknotes for storing (for example, a combination of numbers, alphabet, etc., also referred to below as a "serial number"), and removes banknotes (referred to below as "counterfeits") with specific serial numbers that are deemed to be banknotes not recognizable as genuine (authentic) banknotes (referred to below as "genuine notes").

Moreover, JP-A No. 2005-92421 describes a banknote processing apparatus that manages banknotes being stored, and efficiently takes out only banknotes in a particular sector from a storage box in which a mixture of banknotes are present in plural sectors.

Moreover, JP-A No. 2012-208828 describes a banknote processing apparatus that achieves an increase in efficiency of payout processing and a reduction in payout processing time for banknotes stored in banknote storage boxes, and also provides a means to match a count value of stored notes with the actual number of notes.

SUMMARY OF INVENTION

Technical Problem

However, in existing banknote processing apparatuses installed in ATMs, it is difficult to payout or dispense a banknote of a particular serial number from a storage box both efficiently and with certainty.

The reason for this is that in cash processing devices normally installed in ATMs, storage boxes are generally detachable cassette-style storage boxes, and the cassette-style storage boxes may be removed even in a state in which banknotes remain inside the ATM. Thus, in existing cash processing devices installed in ATMs, even if serial numbers are managed, when a banknote with a particular serial number is stored in a storage box that has been removed, the banknote of that serial number cannot be dispensed after the storage box has been removed. Moreover, in existing banknote processing devices installed in ATMs, even though there are banknote storage boxes provided with a door to enable banknotes to be taken out in an installed state in the ATM (cassette-style banknote storage boxes), there is the problem of managing a key to unlock the door (the security problem of minimizing, as much as possible, the number of users and usage frequency of the key), and, once the door has been opened, the problem of necessity for restricting usage of the serial number information being managed (the loss of assurance of the integrity of the serial number information at the unlocked stage since manually removed banknotes cannot be managed) and the like.

A banknote processing apparatus and a banknote processing method is accordingly desired that is capable of easily detecting and paying out a banknote formed with given identification information, without lowering the security of banknotes being stored.

Solution to Problem

A first aspect is a banknote processing apparatus equipped with one or more banknote storage boxes that store banknotes, the banknote processing apparatus including: (1) an information management section that manages banknote management information including identification information for the banknotes respectively stored in the one or more banknote storage boxes; (2) a search information receiving section that receives input of search information including part of, or all of, the identification information of a banknote to be searched for; (3) a banknote search section that searches for a banknote matching the search information based on information being managed by the information management section; and (4) a payout controller that controls so as to feed out and dispense a detected banknote that has been detected by the banknote search section from one of the one or more banknote storage boxes.

A second aspect is a banknote processing method for a banknote processing apparatus equipped with one or more banknote storage boxes that store banknotes, the banknote processing method including: managing banknote management information including identification information for banknotes respectively stored in the one or more banknote storage boxes; receiving input of search information including part of, or all of, identification information of a banknote to be searched for; searching for a banknote matching the search information based on banknote management information that is being managed; and feeding out and dispensing a banknote that has been detected by the searching from one of the one or more banknote storage boxes.

Effects of Invention

The present aspects enable a banknote processing apparatus to be provided that is capable of easily detecting and paying out a banknote formed with given identification information, without lowering the security of banknotes being stored.

BRIEF DESCRIPTION OF DRAWINGS

FIG. 3 is an explanatory diagram illustrating an example of a configuration of banknote management information of the first exemplary embodiment.

DESCRIPTION OF EMBODIMENTS

(A) First Exemplary Embodiment

Detailed explanation follows regarding a first exemplary embodiment of a banknote processing apparatus and a banknote processing method, with reference to the drawings. Explanation follows regarding an example of the first exemplary embodiment in which a banknote processing apparatus is applied to an ATM.

(A-1) Configuration of First Exemplary Embodiment

Figure 1A:
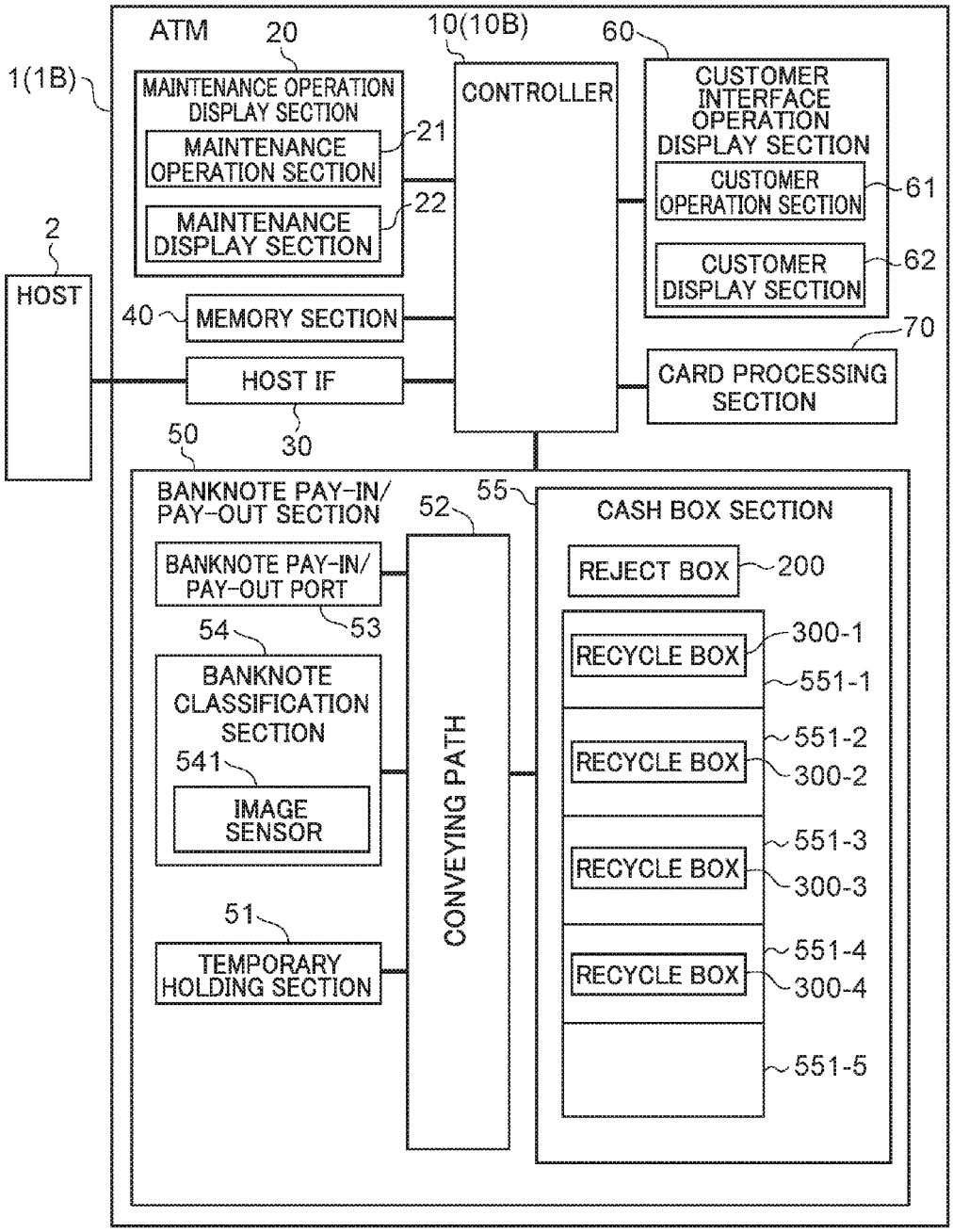
FIG. 1A is a block diagram illustrating a functional configuration of an automated teller machine (ATM) of a first exemplary embodiment.
Figure 1B:
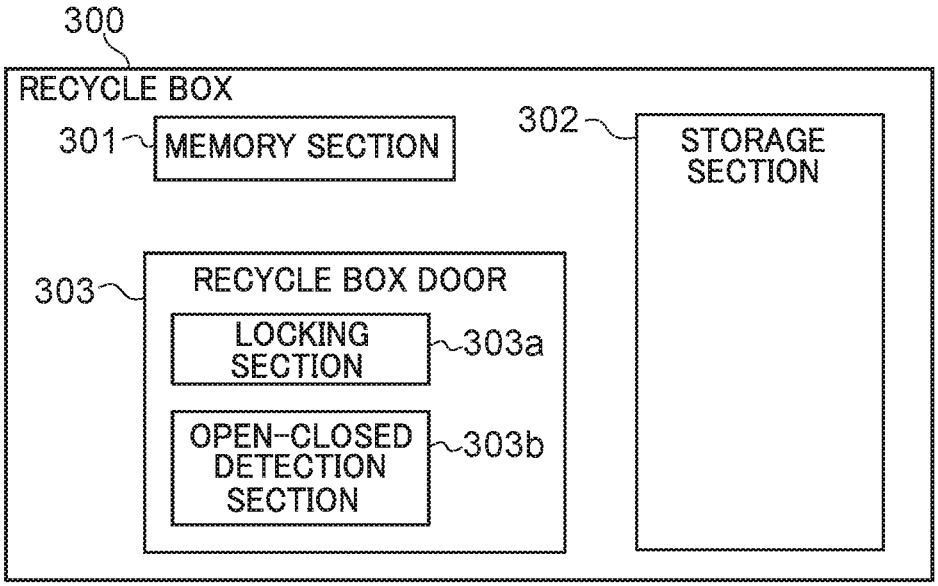
FIG. 1B is a block diagram illustrating an internal configuration of a recycle box configuring the ATM of the first exemplary embodiment.

FIG. 1A and FIG. 1B are block diagrams illustrating a configuration of an ATM 1 of the present exemplary embodiment. FIG. 1A is a block diagram illustrating an overall configuration of the ATM 1. FIG. 1B is a block diagram illustrating an internal configuration of a recycle box 300 configuring the ATM 1.

Figure 2A:
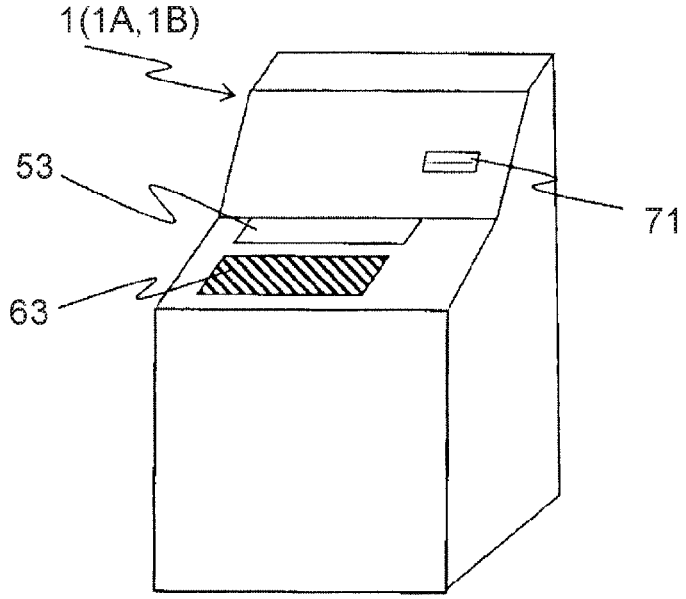
FIG. 2A is a schematic view illustrating an external appearance of the ATM of the first exemplary embodiment.
Figure 2B:
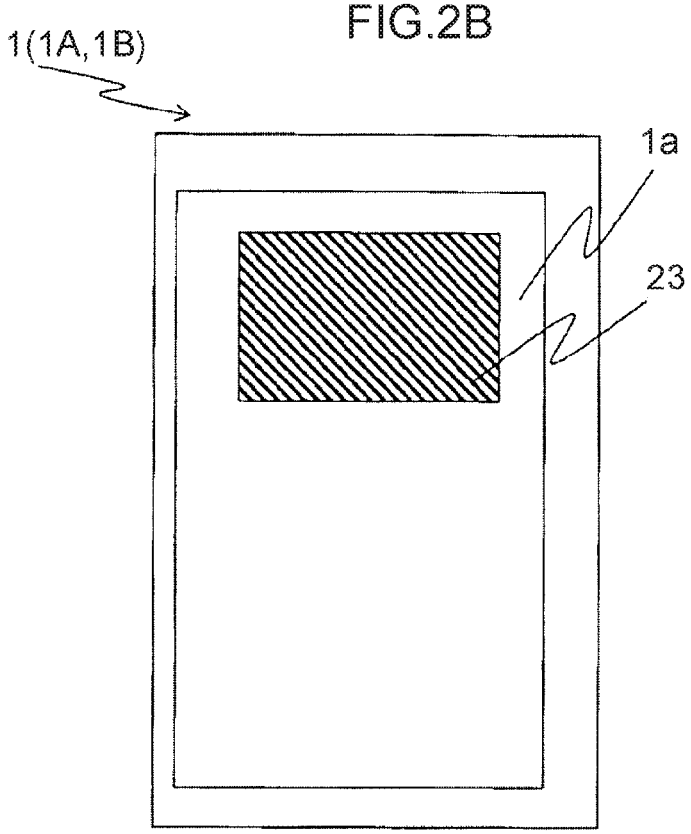
FIG. 2B is a schematic view illustrating an external appearance of the ATM of the first exemplary embodiment.

FIG. 2A and FIG. 2B are schematic diagrams illustrating the external appearance of the ATM 1 of the present exemplary embodiment. FIG. 2A is a perspective view of the external appearance of the ATM 1 (a perspective view as seen from the front face side), and FIG. 2B is a back view of the ATM 1.

The reference numerals in brackets in FIG. 1A and FIG. 1B, and FIG. 2A and FIG. 2B are reference numerals employed in second and third exemplary embodiments described below.

The ATM 1 includes a controller 10, a maintenance operation display section 20, a host IF 30, a memory section 40, a banknote pay-in/pay-out section 50, a customer interface operation display section 60, and a card processing section 70.

A controller 10 performs the function of controlling the operation of each of the sections in the ATM 1. The controller 10 may, for example, be implemented by installing a banknote processing program of the present exemplary embodiment in a program implementation configuration including a processor, memory, and the like. The controller 10 performs the functions of information processing to receive operations by an operator or customer (including processing for presentation of an operation screen and processing accompanying operation reception), information processing according to the operations by the operator or customer, control processing of each of the configuration elements in the ATM 1, and the like.

The memory section 40 is a storage means that stores data such as programs and parameters required in the operation of the controller 10. Non-volatile memory, such as a hard disk drive or flash memory, may, for example, be employed as the memory section 40.

The customer interface operation display section 60 functions as an interface with the customer using the ATM 1, and includes a customer display section 62 for presenting information and the like to the customer, and a customer operation section 61 for receiving operations from the customer. The customer interface operation display section 60 employs a touch panel display 63 (see FIG. 2A) as a device that functions as the customer display section 62 and the customer operation section 61. Configuring the customer interface operation display section 60 with the touch panel display 63 enables various operation screens to be presented to the user. As illustrated in FIG. 2A, the touch panel display 63 configuring the customer interface operation display section 60 is provided at the front face side of the ATM 1.

The maintenance operation display section 20 functions as an interface with a person maintaining or operating the ATM 1 (also referred to below as "operator"), and includes a maintenance operation section 21 that displays information and the like to the operator, and a maintenance display section 22 that receives operation from an operator. Examples of the operator include a member of staff in a store in which the ATM 1 is installed and a maintenance operative that receives a dispatch request from the member of staff and maintains the ATM 1. In the maintenance operation display section 20 a touch panel display 23 using a touch panel method (see FIG. 2B) is employed as the device that functions as the maintenance operation section 21 and the maintenance display section 22. Configuring the maintenance operation display section 20 with the touch panel display 23 enables various operation screens to be presented to the user. The ATM 1 (controller 10) is able to operate in various operation modes according to operation of the maintenance operation display section 20 by the operator. As illustrated in FIG. 2B, the touch panel display 23 configuring the maintenance operation display section 20 is provided at a back face door 1*a* at the back face side of the ATM 1. In the ATM 1, a cash box section 55 is accessible by opening the back face door 1*a*.

The host IF 30 is a networking interface for the ATM 1 to communicate with an external host 2 device.

The card processing section 70 performs processing such as reading recorded data (magnetic recorded data, data recorded on an IC chip or the like) on a card (cash card) by taking in the card inserted by a customer under control of the controller 10.

The banknote pay-in/pay-out section 50 performs, under control of the controller 10, processing to receive and store paid-in banknotes, and processing to payout (dispense) stored banknotes. The banknote pay-in/pay-out section 50 includes a temporary holding section 51, a conveying path 52, a banknote pay-in/pay-out port 53, a banknote classification section 54, and the cash box section 55.

The banknote pay-in/pay-out port 53 performs the function of receiving banknotes inserted by a user, and the function of paying out (dispensing) banknotes to a user.

The conveying path 52 functions as a conveyance means for conveying banknotes inside the banknote pay-in/pay-out section 50. The conveying path 52 employed may be similar to those of various ATMs. For example, the conveying path 52 may be implemented by employing a belt to nip and convey banknotes, rollers to drive the belt, plates to switch the direction for conveying of the banknotes and, therefore, detailed explanation thereof is omitted.

The classification section 54 performs the function of classifying banknotes on the conveying path 52. The classification section 54 classifies, for example, by denomination of banknote, authenticity of banknote, degree of damage to banknote, banknote serial number, and the like. The classification section 54 includes an image sensor 541 that acquires a captured image of the banknote, and performs classification according to the image acquired by the image sensor 541. The classification section 54 (including the image sensor 541) may be implemented by employing one similar to those of existing banknote classification devices and, therefore, detailed explanation thereof is omitted. Hereinafter, banknotes (genuine notes) that are in a badly damage state such that they are not suitable for storage in the ATM 1 are referred to as "damaged notes", and banknotes (genuine notes) that are in a state capable of storage in the ATM 1 are referred to as "normal notes". In the banknote pay-in/pay-out section 50, normal notes are recognized as banknotes to be stored (referred to below as "storage banknotes"), and other banknotes (counterfeits or damaged notes) are treated as banknotes to be rejected (referred to below as "reject banknotes").

The cash box section 55 stores deposited banknotes and banknotes for paying out, and includes a reject box 200 for storing reject banknotes. The cash box section 55 is provided with five housing slots 551 (551-1 to 551-5) for housing the recycle boxes 300. One of the recycle boxes 300 is detachably set (housed) in each of the housing slots 551-1 to 551-5. In the ATM 1 illustrated in FIG. 1A, the recycle boxes 300-1 to 300-4 are respectively housed in the four housing slots 551-1 to 551-4. The housing slot 551-5 does not house one of the recycle boxes 300, and is an empty slot.

In the banknote pay-in/pay-out section 50, the banknotes to be stored out of the paid-in banknotes are stored in one of the recycle boxes 300. In the banknote pay-in/pay-out section 50, the reject banknotes out of the paid-in banknotes are stored in the reject box 200.

Explanation next follows regarding an internal configuration of each of the recycle boxes 300, with reference to FIG. 1B.

As illustrated in FIG. 1B, a memory section 301 and a storage section 302 that is a space for storing banknotes are provided in the recycle box 300. A recycle box door 303 is provided at an opening portion of the storage section 302. The recycle box door 303 is lockable by a locking section 303*a*. In the recycle box 300, the banknotes in the storage section 302 are accessible to an operator when the recycle box door 303 is in the open state. In the recycle box 300, the recycle box door 303 is lockable by the locking section 303*a* when in a closed state. The locking section 303*a* is unlockable by a key, not illustrated in the drawings.

The recycle box 300 is also provided with an open-closed detection section 303*b* for detecting the open state or the closed state of the recycle box door 303. The open-closed detection section 303*b* is equipped with a power supply (storage battery), not illustrated in the drawings, to enable detection of transition to closed state or open state of the recycle box door 303, and to enable the history thereof (referred to below as open-closed detection history) to be recorded, even when in a removed state from the ATM 1. The open-closed detection section 303*b* may, for example, be configured by employing an open-closed sensor, and accumulation means for open-closed detection history (for example a microcomputer, and accumulation means configured by non-volatile memory). When in an installed state in the ATM 1, the open-closed detection section 303*b* is electrically connected to the controller 10 by a signal line or the like, not illustrated in the drawings, and the controller 10 is able to access the open-closed detection section 303*b* of each of the recycle boxes 300, and to reference the open-closed detection history accumulated in the open-closed detection section 303*b*. The recycle box door 303 needs to be in the open state when an operator accesses banknotes in the storage section 302, and the recycle box 300 is configured so that this open or closed state is detected by the open-closed detection section 303*b*. Thus, in the recycle box 300, the safety (security) of banknotes stored in the storage section 302 is managed by the recycle box door 303 (the locking section 303*a*, and the open-closed detection section 303*b*).

The memory section 301 stores information for managing the banknotes stored in the storage section 302 of the recycle box 300. In the recycle box 300, in order to maintain a matched state between the information of the memory section 301 and the banknotes inside the storage section 302, the information in the memory section 301 may be rendered invalid when the recycle box door 303 is in an open state.

FIG. 3 is a block diagram illustrating an example of a configuration of banknote management information stored in the memory section 301.

As illustrated in FIG. 3, the position of a stored banknote (referred to below as "storage position"), denomination, serial number, and image data of the serial number portion of the banknote (an image captured by the banknote classification section 54, referred to below as "serial number image") is stored as management information for each of the banknotes (referred to below as "banknote management information") in the memory section 301. In FIG. 3, for ease of illustration, the serial number images are shown with names of the respective image data ("image G001", "image G002", etc.).

The storage position item is set with a value indicating the storage position of the banknote in the storage section 302. The storage position indicates the sequence of storage of the banknotes in the storage section 302, with the banknote with the highest storage position value being the banknote that has been stored last. In FIG. 3, since the banknote management information is recorded for banknotes with storage positions 1 to 40, it is indicated that there are 40 banknotes stored in the storage section 302 of the recycle box 300. As the banknote management information, the serial number item should be included as a minimum, and the other items may be omitted.

Detailed explanation follows regarding banknote management processing by the controller 10.

The controller 10 performs banknote management processing for managing banknotes stored in each of the recycle boxes 300.

In the storage section 302, the banknotes are stored by stacking, with new banknotes for storing stacked on top of the uppermost banknote already stored. In such cases, when feeding out stored banknotes, the storage section 302 feeds out the banknotes from the uppermost stacked banknote. Thus, when feeding out banknotes, the storage section 302 feeds out banknotes in sequence from the banknote having the highest storage position value.

When storing a new banknote in the recycle box 300, the controller 10 adds banknote management information set with the serial number and denomination of the banknote (the serial number and denomination read by the banknote classification section 54) to the memory section 301. When feeding out a banknote from the recycle box 300, the controller 10 deletes the banknote management information having the highest storage position value. The controller 10 thereby maintains the information stored in the memory sections 301 of the respective recycle boxes 300 in a synchronized state with the housed states in each of the storage sections 302. Alternatively, when feeding out a banknote from the recycle box 300, the controller 10 may identify the serial number of the banknote that has been fed out using the banknote classification section 54, and may erase the banknote management information of that serial number from the memory section 301.

When information about a banknote to be searched for (referred to below as "search information") is entered by an operator using the maintenance operation display section 20, the controller 10 references the banknote management information recorded in each of the recycle boxes 300, and performs banknote search processing to detect the banknote in the searched information. A banknote detected by the banknote search processing is referred to below as a "detected banknote".

In cases in which an instruction is given by an operator using the maintenance operation display section 20 to pay out a detected banknote, the controller 10 performs processing to feed out, and pay out, the detected banknote from the target recycle box 300. When the detected banknote is not in the next feedable position in the recycle box 300 (when it is not the banknote with the highest storage position value), the controller 10 temporarily holds the banknotes of that recycle box 300 in the temporary holding section 51 until the detected banknote is feedable. Then, after feeding out and paying out the detected banknote (dispensing from the banknote pay-in/pay-out port 53), the controller 10 controls so as to return banknotes temporarily held in the temporary holding destination (the temporary holding section 51) to the original recycle box 300.

(A-2) Operation of the First Exemplary Embodiment

Figure 4:
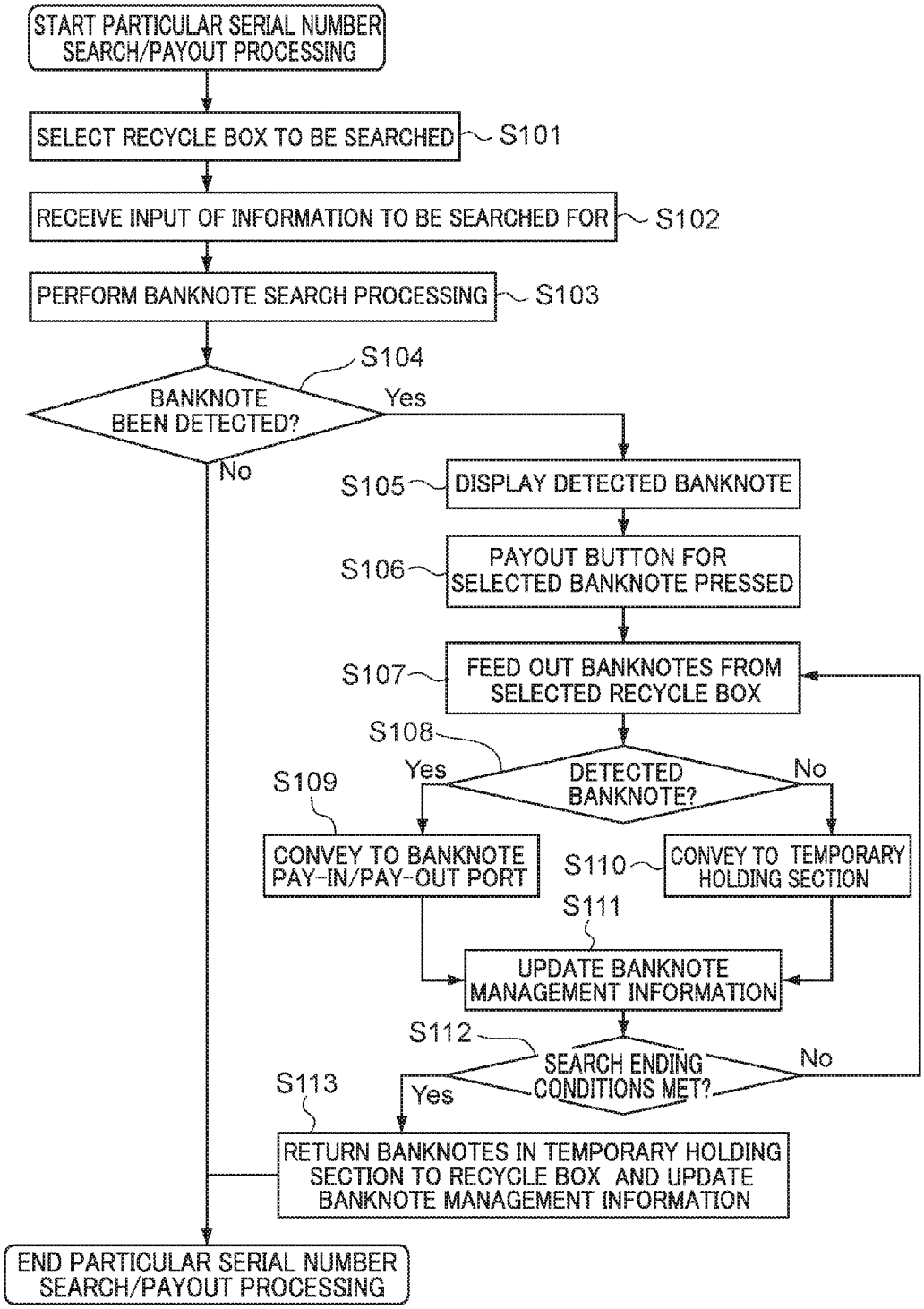
FIG. 4 is a flow chart illustrating an operation of the ATM (controller) of the first exemplary embodiment.

Explanation next follows regarding operation of the ATM 1 of the first exemplary embodiment configured as described above (a banknote processing method of the present exemplary embodiment), with reference to a flowchart of FIG. 4.

The controller 10 invokes a screen for selecting the recycle box 300 to execute banknote search processing (referred to below as the "search cassette selection screen") when the maintenance operation display section 20 is operated by operation of an operator, and the banknote search processing is requested (S101). The controller 10, for example, displays a start menu screen, not illustrated in the drawings, on the maintenance operation display section 20, and the banknote search processing is requestable on the start menu screen.

Figure 5:
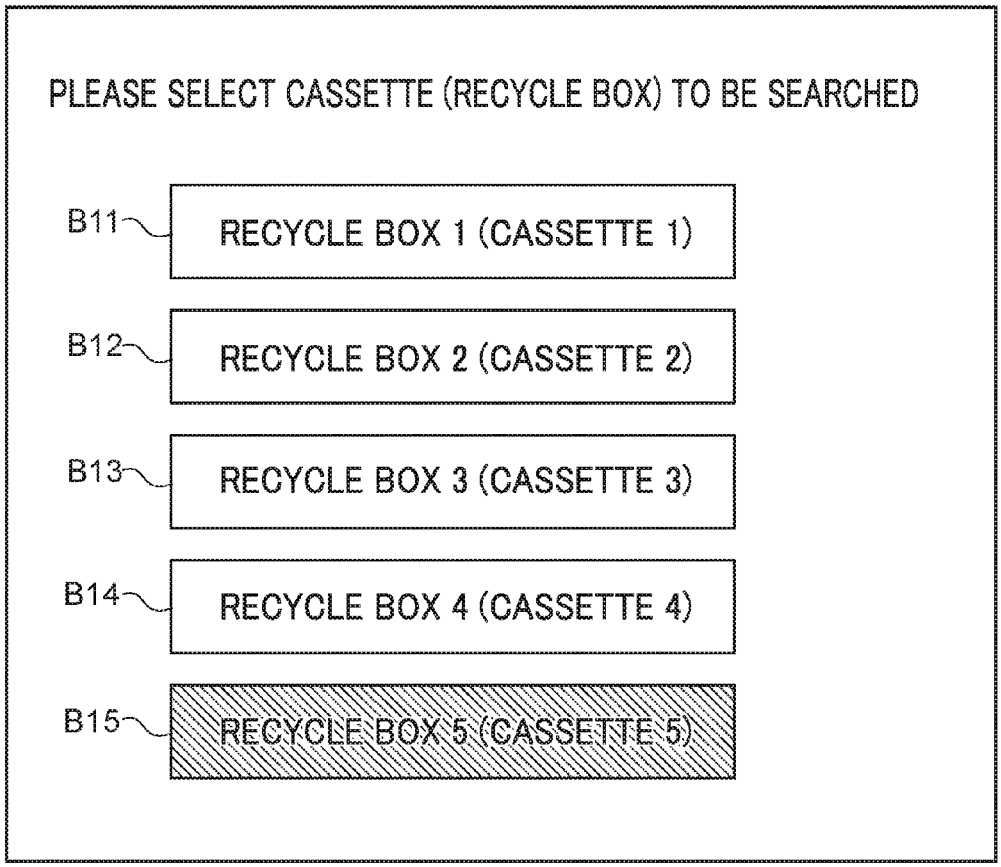
FIG. 5 is an explanatory diagram illustrating an example of a configuration of a search cassette selection screen displayed at the ATM of the first exemplary embodiment.

FIG. 5 is an explanatory diagram illustrating an example of a configuration of a search cassette selection screen.

Buttons B11 to B15 corresponding to the housing slots 551-1 to 551-5 are disposed on the search cassette selection screen illustrated in FIG. 5. For example, when one of the buttons B11 to B15 is touched on the search cassette selection screen, the housing slot 551-1 (the recycle box 300-1) is selected as the search cassette. Note that the housing slot 551-5 is an empty slot (a slot not housing a recycle box 300). The button B15 corresponding to the housing slot 551-5 on the search cassette selection screen of FIG. 5 is accordingly in an invalid state (a non-selectable state illustrated by shading in FIG. 5).

After one of the recycle boxes 300 (the housing slot 551) has been selected on the search cassette selection screen, the controller 10 causes the touch panel display 23 of the maintenance operation display section 20 to display a screen (referred to below as a banknote search and payout screen) for accepting search processing or payout processing (referred to below as particular serial number search/payout processing) for a banknote with a particular serial number, and search information may be input (S102).

Figure 6:
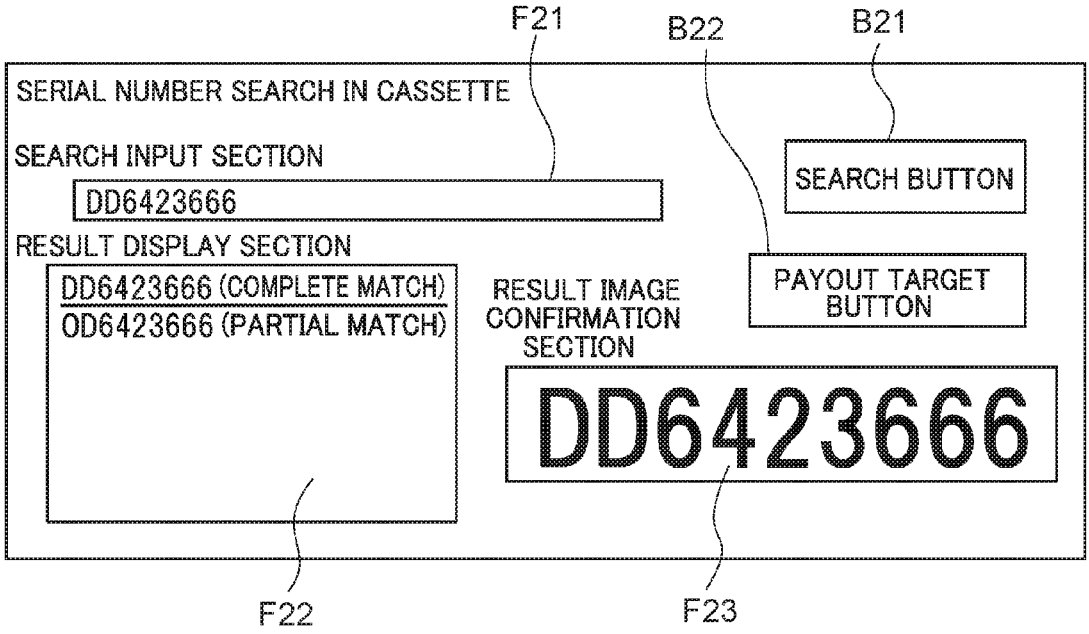
FIG. 6 is an explanatory diagram illustrating an example of a configuration of a banknote search and payout screen displayed at the ATM of the first exemplary embodiment.

FIG. 6 is an explanatory diagram illustrating an example of a configuration of a banknote search and payout screen.

The banknote search and payout screen illustrated in FIG. 6 is disposed with a field F21 for inputting search information (part of, or all of the digits, of the serial number), a button B21 for starting banknote search processing for the serial number input to field F21, a field F22 for displaying the search results, a field F23 for displaying a serial number image of the detected banknote selected at field F22, and a button B22 for starting payout processing of the detected banknote (the banknote with the serial number displayed on the field F22).

When search information is input to the banknote search and payout screen and the button B21 is touched, the controller 10 reads the information of the memory section 301 of the recycle box 300 that is the cassette to be searched, searches for a banknote (banknote management information) including the number of the search information as its serial number (S103), and confirms the search result (S104).

In cases in which banknote management information for this banknote has been detected by the controller 10 in the memory section 301 of the recycle box 300 that is the cassette to be searched, processing transitions to step S105, described below, and otherwise the particular serial number search/payout processing is ended.

At above step S104, in cases in which the banknote management information for this banknote has been detected, the controller 10 displays the serial number for the detected banknote in the field F22. When the controller 10 displays the serial number in the field F22, display is annotated with an annotation for "complete match" for serial numbers that completely match the search information (for which all the digits match), and with an annotation for "partial match" for serial numbers that partially match the search information (have one digit different, but other digits match), as illustrated in FIG. 6.

For example, in the banknote search and payout screen of FIG. 6, the search information is "DD6423666", and "DD6423666 (complete match)" is displayed in the field F22 for a completely matching banknote, and "OD6423666 (partial match)" is displayed in the field F22 for a partially matching banknote. The controller 10 may be configured to only detect banknotes with a serial number completely matching the search information on the banknote search and payout screen, and the conditions for a partial match are not limited to the example given above.

One of the detected banknote serial numbers is selectable (selectable by touch) on the banknote search and payout screen. In FIG. 6, the serial number image of the selected banknote is displayed in field F23.

When the button B22 (payout button) is selected on the banknote search and payout screen (S106), the controller 10 starts the payout processing for the detected banknote (dispense processing from the banknote pay-in/pay-out port 53).

When the payout processing of the detected banknote has been started, the controller 10 feeds out one banknote from the selected recycle box 300, identifies the serial number using the banknote classification section 54 (S107), and confirms whether or not the serial number matches that of any detected banknote (S108).

When the serial number of the banknote fed out from the recycle box 300 matches the serial number of a detected banknote, the controller 10 conveys the banknote to the banknote pay-in/pay-out port 53 and pays out (dispenses) the banknote (S109).

However, when the serial number of the banknote fed out from the recycle box 300 does not match the serial number of the detected banknote, the controller 10 conveys the banknote to the temporary holding section 51 and temporarily holds the banknote (S110).

When steps S109 or S110 have been completed, the controller 10 updates the banknote management information stored in the selected recycle box 300 (the memory section 301 thereof) (i.e., erases the banknote management information of the fed out banknote) (S111).

The controller 10 then confirms whether or not conditions to end the search processing have been met. Processing transitions to step S113, described later, when determined that the ending conditions have been met, and otherwise processing transitions to step S107, described above. In this case, the controller 10 determines that conditions to end the search processing have been met when one condition of "all detected banknotes have been paid out", or "the selected recycle box 300 is empty of banknotes" is satisfied.

When determined at step S112 that the conditions to end the search processing have been met, the controller 10 feeds out any banknotes temporarily held in the temporary holding section 51, returns them to their original recycle box 300, updates the information stored on the memory section 301 of the recycle box 300 (processing to add the banknote management information of the banknotes returned to the recycle box 300) (S113), and then ends the particular serial number search/payout processing.

When banknotes are returned to the recycle box 300 from the temporary holding section 51, the controller 10 updates the banknote management information of the memory section 301 of the recycle box 300 (processing to add the banknote management information of the banknotes returned to the recycle box 300). This may be implemented by the controller 10 identifying the serial number or the like of the banknote fed out from the temporary holding section 51 using the banknote classification section 54, and generating the banknote management information for adding.

(A-3) Effects of First Exemplary Embodiment

The following effects may be exhibited by the first exemplary embodiment.

In the ATM 1, a banknote of a given serial number may be dispensed from the recycle box 300 through the banknote pay-in/pay-out port 53 by using the particular serial number search/payout processing illustrated in the flowchart of FIG. 4. In other words, in the ATM 1, a banknote with a particular serial number suspected to be a counterfeit or the like may be dispensed from the banknote pay-in/pay-out port 53, without opening the recycle box door 303 of the recycle box 300. In the ATM 1, this thereby enables easy removal, visual inspection, and the like of a banknote of a particular serial number, and enables preventing detachment of the recycle box with the banknote of the particular serial number still being stored inside the recycle box.

In the ATM 1, when dispensing the detected banknote, the banknotes other than the detected banknote are held in the temporary holding section 51, and the banknotes held in the temporary holding section 51 are returned to the recycle box 300 after the detected banknote has been dispensed and, when this is performed, the banknote management information of the memory section 301 is also updated. Thus, in the ATM 1, the content of the banknote management information of the memory section 301 can be maintained as synchronized while detected banknotes are being dispensed without opening the recycle box door 303 of the recycle box 300.

(B) Second Exemplary Embodiment

Detailed explanation follows regarding a second exemplary embodiment of a banknote processing apparatus and banknote processing method, with reference to the drawings. Explanation follows regarding an example of the second exemplary embodiment in which a banknote processing apparatus is applied to an ATM.

(B-1) Configuration of Second Exemplary Embodiment

Figure 7:
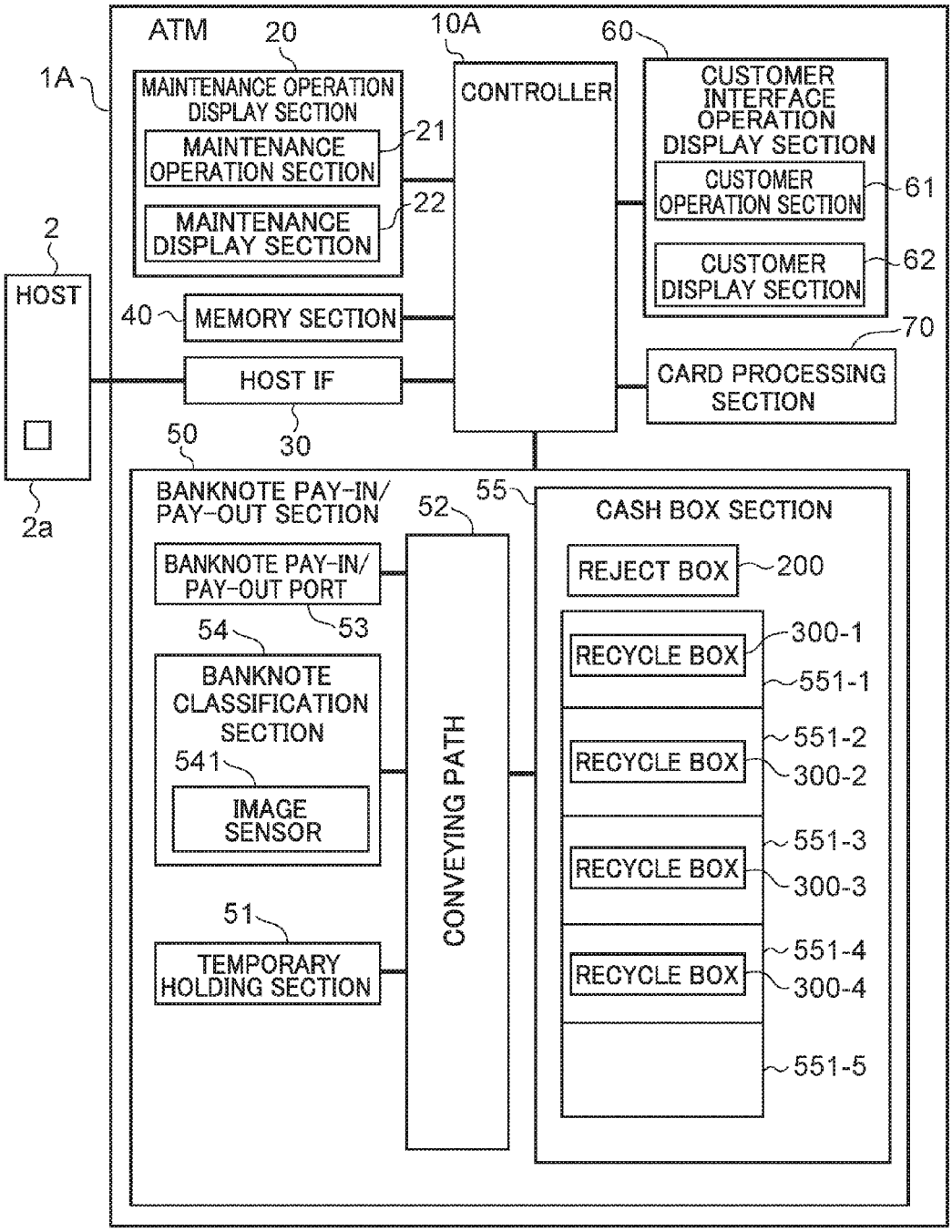
FIG. 7 is a block diagram illustrating a functional configuration of an ATM of a second exemplary embodiment.

FIG. 7 is a block diagram illustrating a functional configuration of an ATM 1A according to the second exemplary embodiment.

The ATM 1A of the second exemplary embodiment differs from the first exemplary embodiment in that the controller 10 is substituted by a controller 10A.

The ATM 1 (the controller 10) of the first exemplary embodiment is configured such that the search information of the particular serial number search/payout processing is input by an operator, however, the second exemplary embodiment differs therefrom in that configuration is made such that the search information is downloaded from a host 2.

More specifically, in the second exemplary embodiment, during particular serial number search/payout processing, search information 2*a* (a list of serial numbers to be searched) is downloaded from the host 2 and search processing (matching processing) is performed.

(B-2) Operation of the Second Exemplary Embodiment

Figure 8:
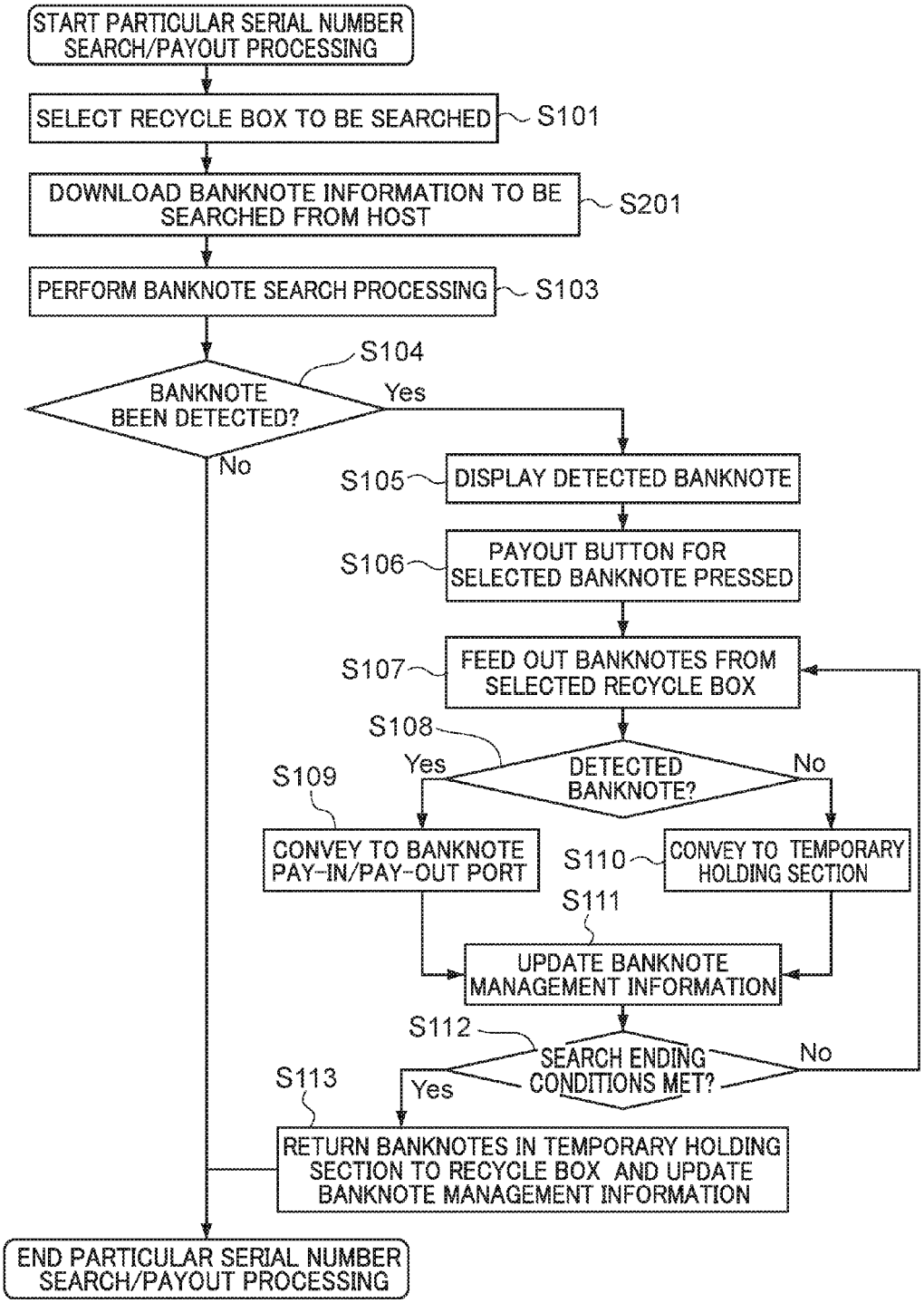
FIG. 8 is a flow chart illustrating an operation of the ATM (controller) of the second exemplary embodiment.

Explanation follows regarding differences in the operation of the ATM 1A of the second exemplary embodiment configured as described above (the banknote processing method of the present exemplary embodiment) from that of the first exemplary embodiment, with reference to the flowchart of FIG. 8. The flowchart of FIG. 8 has substantially the same content as that of the first exemplary embodiment, except in that the processing of step S102 is substituted by step S201.

First, when the cassette to be searched (one of the recycle boxes 300) has been selected at step S101 by user operation on a search cassette selection screen, the controller 10A displays a banknote search and payout screen on the maintenance operation display section 20.

Figure 9:
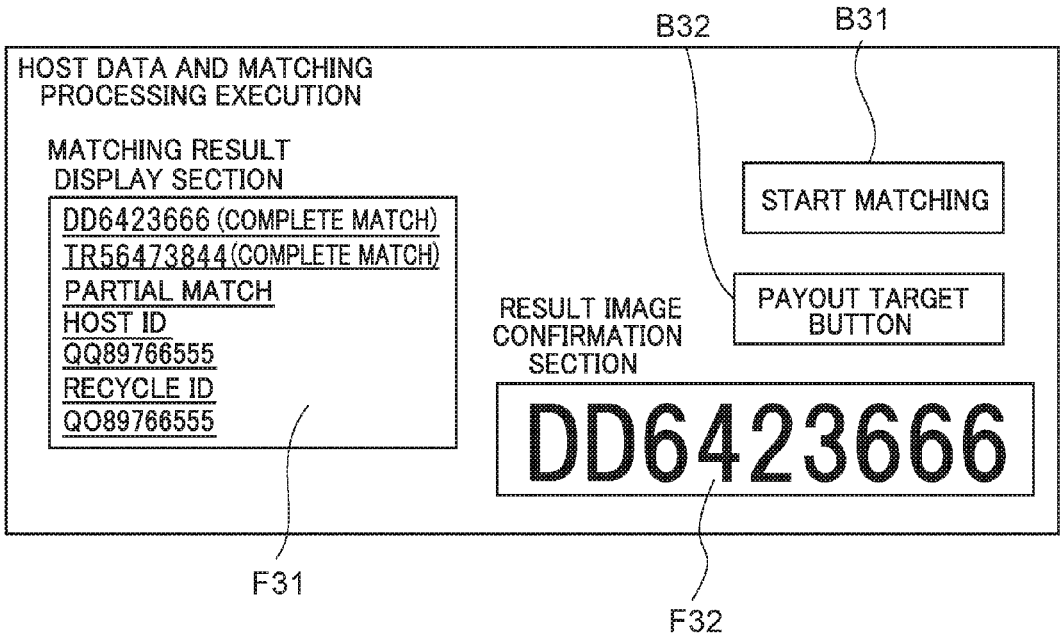
FIG. 9 is an explanatory diagram illustrating an example of a configuration of a banknote search and payout screen displayed at the ATM of the second exemplary embodiment.

FIG. 9 is an explanatory diagram illustrating an example of a configuration of a banknote search and payout screen according to the second exemplary embodiment.

The banknote search and payout screen illustrated in FIG. 9 is disposed with a button B31 for starting banknote search processing (matching), a field F31 for displaying the search results, a field F32 for displaying a serial number image of a banknote corresponding to the serial number selected in field F31, and a button B32 for starting payout processing of the detected banknote (the banknote with the serial number displayed in the field F31). The functions corresponding to the fields F31, F32, and the button B32 are similar to those of the first exemplary embodiment (the fields F22, F23, and the button B22 of FIG. 6 above), and so detailed explanation thereof will be omitted.

When the button B31 for starting the banknote search processing (matching) has been selected on the banknote search and payout screen illustrated in FIG. 9, the controller 10A accesses the host 2 via the host IF 30, and acquires the search information 2*a* (S201). The controller 10A then uses the acquired search information 2*a* in the processing of above steps S103 to S113 to execute the particular serial number search/payout processing. The controller 10A of the second exemplary embodiment is similar to that of the first exemplary embodiment, except for in that the second exemplary embodiment uses the search information 2*a* acquired from the host 2, and so detailed explanation thereof will be omitted.

(B-3) Effects of the Second Exemplary Embodiment

The following effects may be exhibited by the second exemplary embodiment.

In the ATM 1A (the controller 10A) of the second exemplary embodiment, the search information 2*a* is downloaded from the host 2. In a financial institution or the like, since there are cases of searching for banknotes with a particular serial number in all branches at the same time by using the same list, a more efficient operational environment may be provided by centralizing management in the host 2 than would be achieved by operators inputting search information at each of the ATMs. Namely, in the ATM 1A (the controller 10A), more efficient and certain search and removal of banknotes having a particular serial number may be performed by configuration such that the search information 2*a* is downloaded from the host 2.

(C) Third Exemplary Embodiment

Detailed explanation follows regarding a third exemplary embodiment of a banknote processing apparatus and banknote processing method, with reference to the drawings. Explanation follows regarding an example of the third exemplary embodiment in which a banknote processing apparatus is applied to an ATM.

(C-1) Configuration of Third Exemplary Embodiment

The functional configuration of an ATM 1B according to the third exemplary embodiment can also be illustrated by using FIG. 1A. The reference numerals in brackets in FIG. 1A are reference numerals employed only in the third exemplary embodiment.

The ATM 1B of the third exemplary embodiment differs from that of the first exemplary embodiment in that the controller 10 is substituted by a controller 10B.

In the ATM 1 (the controller 10) of the first exemplary embodiment, during particular serial number search/payout processing, banknotes are temporarily held in the temporary holding section 51. However, the ATM 1B (the controller 10B) of the third exemplary embodiment differs from that of the first exemplary embodiment in that configuration is made such that the holding destination of banknotes is dynamically selected.

A temporary holding section is normally provided in ATMs to hold banknotes until a transaction to pay in cash has been completed and, therefore, the capacity of the temporary holding section is less than that of a cash box (recycle box) for storing normal banknotes. Thus, in the ATM 1 of the first exemplary embodiment, there is a concern that during paying out of a banknote of a detected serial number from the recycle box 300, the spare capacity of the temporary holding section 51 might be exhausted before the banknote of that serial number is fed out. Therefore, in the ATM 1B (the controller 10B) of the third exemplary embodiment, configuration is made such that the other recycle box 300 is also selectable as the temporary holding destination for banknotes. Although the ATM 1B (the controller 10B) is not limited in the object and priority for selecting the temporary holding destination for banknotes, configuration may be made such that, for example, a recycle box 300 storable with banknotes of the same denomination as the banknotes with the detected serial number, and having the most spare capacity, is prioritized for selection.

(C-2) Operation of the Third Exemplary Embodiment

Figure 10:
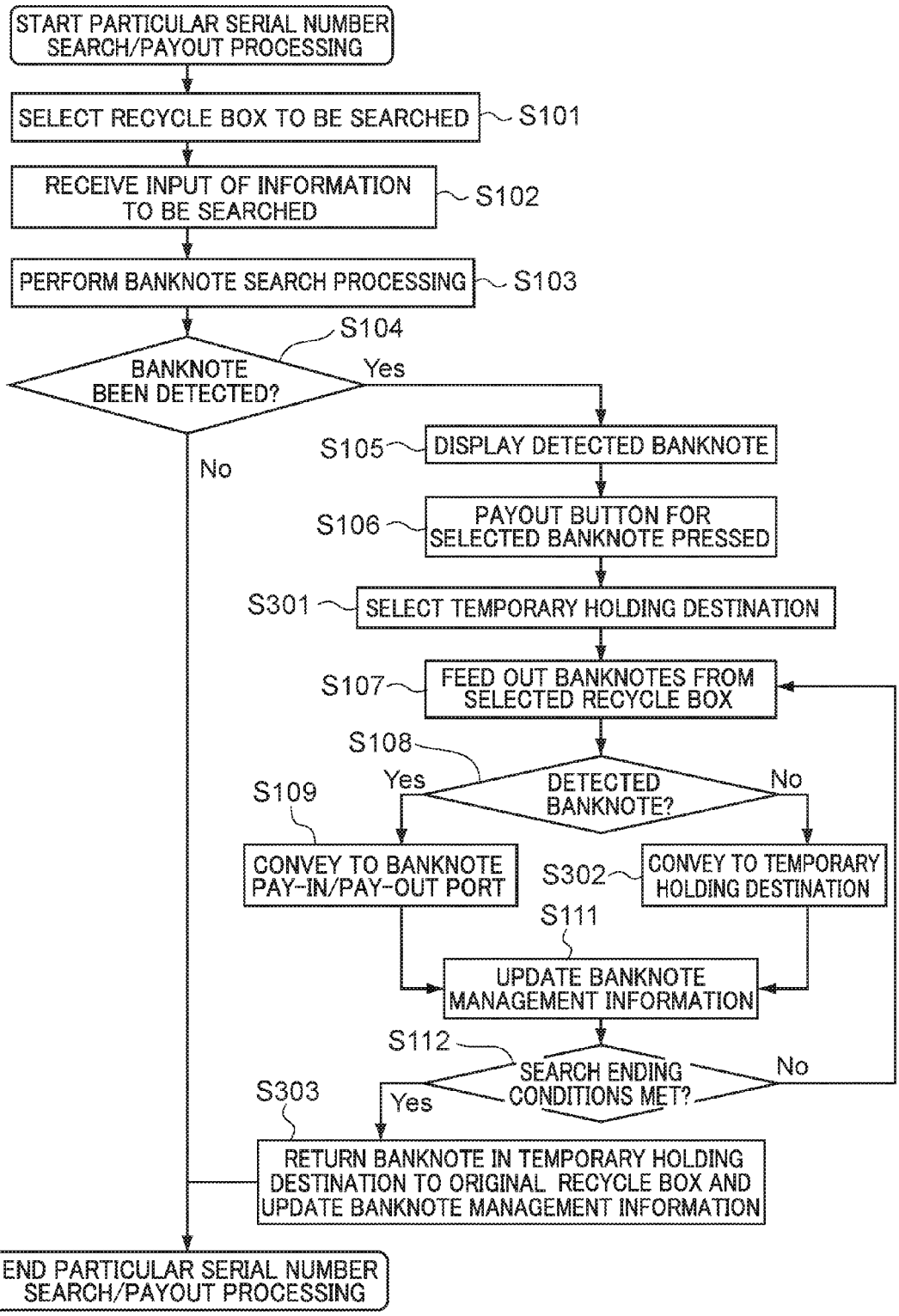
FIG. 10 is a flow chart illustrating an operation of an ATM (controller) of a third exemplary embodiment.

Explanation follows regarding differences in the operation of the ATM 1B of the third exemplary embodiment configured as described above (the banknote processing method of the present exemplary embodiment) from that of the first exemplary embodiment, with reference to the flowchart of FIG. 10. The flowchart of FIG. 10 differs from that of the first exemplary embodiment in that the processing of step S301 is inserted between steps S106 and S107, and the processing of steps S110, S113 is substituted by the respective processing of steps S302, S303.

When the button B22 (payout button) is pressed at step S106 and the payout processing of a detected banknote is started (dispense processing from the banknote pay-in/payout port 53), firstly, the controller 10B selects the temporary holding destination by the processing of step S301, then transitions to the processing of step S107. An example of the method used by the controller 10B for selecting the temporary holding destination is as given above.

When the serial number of the banknote that has been fed out from the recycle box 300 is determined at step S108 to match the serial number of the detected banknote, the controller 10B conveys the banknote to the selected temporary holding destination at step S302, and temporarily holds the banknote.

Moreover, when it is determined at step S112 that the search processing ending conditions have been met, the controller 10B performs processing to return the banknote being temporarily held in the temporary holding destination to its original recycle box 300 in the processing of step S303. When a recycle box 300 already storing banknotes is selected as the temporary holding destination, the controller 10B needs to control so as to count the number of banknotes being temporarily held (the number of banknotes that were temporarily held at step S302), to feed out that number of banknotes from the recycle box of the temporary holding destination, and to return these banknotes to the original recycle box 300.

The controller 10B may select a recycle box that is already storing a different denomination from the detected banknote as the temporary holding destination. In such cases, the controller 10B may feed out one more banknote than the number of banknotes being temporarily held, detect the change in denomination (the switch in denomination of banknotes from the denomination of the detected banknote to that of the banknotes original stored in the temporary holding destination) by classifying the denomination with the banknote classification section 54, so as to more certainly recover the temporary held banknote.

(C-3) Effects of Third Exemplary Embodiment

The following effects can be exhibited by the third exemplary embodiment.

The ATM 1B (the controller 10B) selects an appropriate temporary holding destination during pay out processing of a detected banknote. This thereby enables the ATM 1B (the controller 10B) to more certainly pay out (dispense) a detected banknote.

(D) Other Exemplary Embodiments

Exemplary embodiments are not limited to the exemplary embodiments described above, and examples of exemplary modified embodiments are given below.

(D-1) Explanation has been given in each of the above exemplary embodiments of examples in which the banknote processing apparatus is applied to an automated teller machine (ATM) in a financial institution or the like, however application may be made to other apparatuses that store banknotes. For example, application may be made to an exemplary embodiment of a banknote processing apparatus, such as in a pay-in/pay-out apparatus employed in a store or the like for managing cash such as change.

Figure 11:
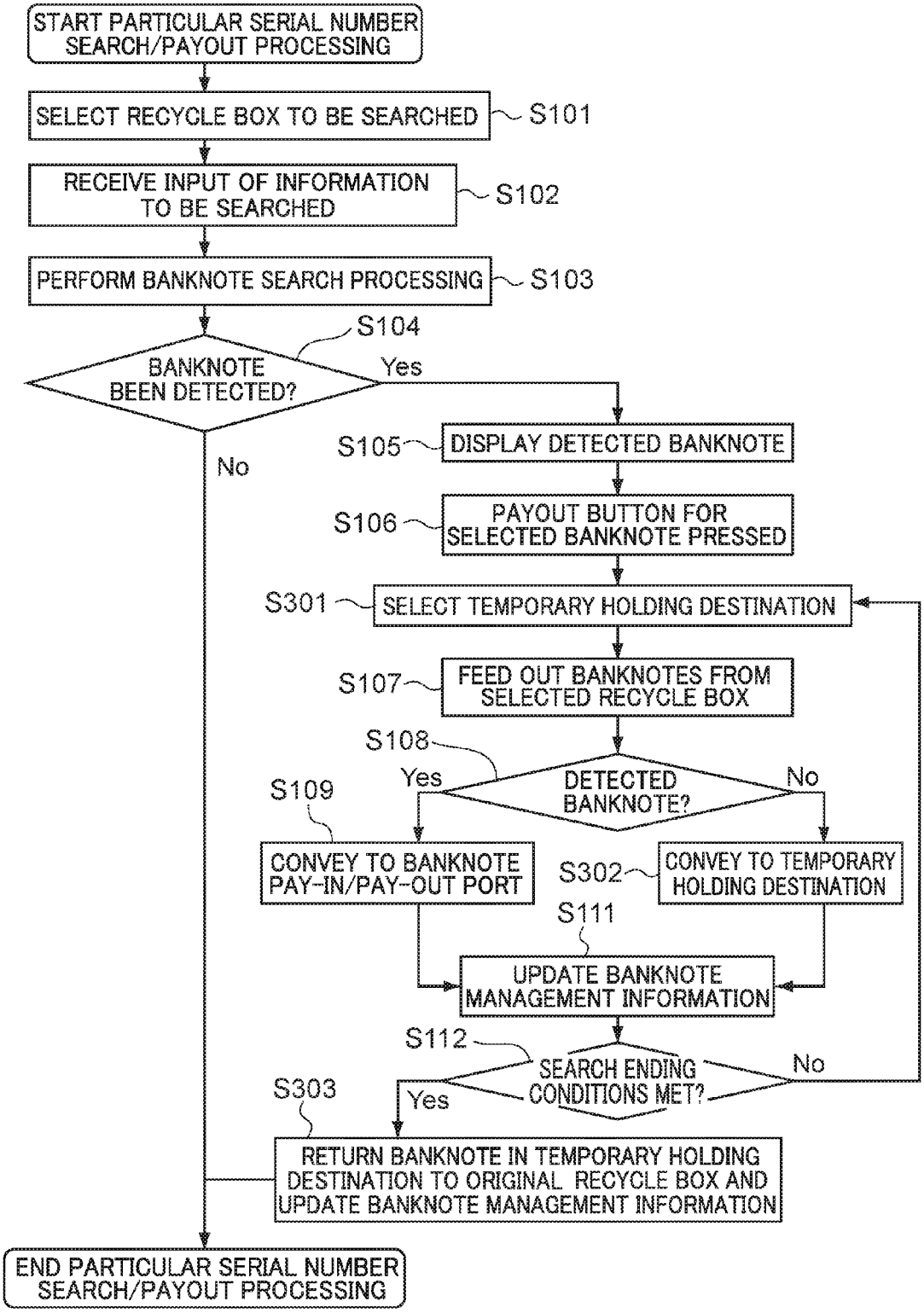
FIG. 11 is a flow chart illustrating an operation of a modified example the ATM (controller) of the third exemplary embodiment.

(D-2) In the third exemplary embodiment, when paying out the found banknote, the ATM 1B (the controller 10B) selects the temporary holding destination at step S301. However, as illustrated in the flowchart of FIG. 11, in consideration of cases in which spare capacity is no longer available in the first selected temporary holding destination, configuration may be made such that the temporary holding destination is reconsidered each time a banknote is fed out from the selected recycle box 300. The flowchart of FIG. 11 illustrates a modified example of the flowchart of the third exemplary embodiment (the flowchart of FIG. 10). In the flowchart of FIG. 11, when the search ending conditions are not met at step S112, and the next banknote is fed out from the selected recycle box 300, the ATM 1B (the controller 10B) is configured so as to return to the operation of step S301, and to reconsider the temporary holding destination again. In this case, when spare capacity is no longer available in the first selected temporary holding destination, the ATM 1B (the controller 10B) is configured to then perform processing to select the next temporary holding destination. Configuration may be made such that in cases in which there is no longer any spare capacity available in any of the recycle boxes 300, the ATM 1B (the controller 10B) requests an operator to set up another recycle box 300 in the empty housing slot 551 (for example, by displaying a message on the maintenance operation display section 20), so as to secure a temporary holding destination.

(D-3) Although in each of the above exemplary embodiments, the banknote management information of each of the recycle boxes 300 is stored distributed across the respective recycle boxes 300, configuration may be made such that the banknote management information is centrally managed at the ATM main body (controller), or at the host computer. This thereby eliminates the need to instruct the recycle box in the banknote search processing in each of the exemplary embodiments described above.

(D-4) In each of the exemplary embodiments described above, when the ATM performs banknote search processing, the search may be performed for a banknote of the target serial number from a state in which it is not known if it is actually being held or not, and configuration may be made such that a banknote of the target serial number is paid out (dispensed) if the banknote can be detected, and an operator notified if the target banknote cannot be detected (for example, by outputting display of a message on the maintenance operation display section 20). There is, accordingly, no need to receive a serial number search along with specification of the recycle box, as in the banknote search processing performed by the ATM in each of the exemplary embodiments described above.

(D-5) In each of the exemplary embodiments described above, the banknote management information is managed in the ATM. However, banknote search processing may be performed to classify all the banknotes in the recycle boxes using the classification section, and to confirm their serial numbers in cases in which there is no banknote management information being held or no management of a serial number item.

The invention claimed is:

1. A banknote processing apparatus comprising:

a banknote pay-in/pay-out port that receives banknotes inserted by a user, and pays out banknotes to a user;

one or more banknote storage boxes that store banknotes;

an information management section that manages banknote management information including a serial number for banknotes respectively stored in the one or more banknote storage boxes;

a search information receiving section that receives input of search information including part of, or all of, a serial number of a banknote to be searched for;

a banknote search section that searches for a banknote matching the search information based on information being managed by the information management section;

a classification section that classifies at least serial numbers of banknotes;

a banknote temporary holding section that temporarily holds banknotes; and a payout controller that effects control of feeding out banknotes from one of the one or more banknote storage boxes, classifying serial numbers of the fed-out banknotes by the classification section, temporarily storing the fed-out banknotes in the banknote temporary holding section until a banknote with a serial number of the search information is detected, after the banknote with the serial number of the search information is detected, dispensing the detected banknote to the banknote pay-in/pay-out port, and thereafter returning the fed-out banknotes stored in the banknote temporary holding section to the one of the one or more banknote storage boxes.

2. The banknote processing apparatus of claim 1, wherein:

the one or more banknote storage boxes are detachably installed in the banknote processing apparatus;

the information management section is configured by a banknote management information memory section placed in each of the one or more banknote storage boxes; and the banknote management information memory section for each of the banknote storage boxes stores the banknote management information of the banknotes being stored in corresponding each of the banknote storage boxes.

3. The banknote processing apparatus of claim 1, wherein each of the banknote storage boxes comprises:

a storage section that stores banknotes;

an opening and closing member that is provided in an opening portion of the storage section;

a lock section that locks the opening and closing member; and an open-closed detection section that detects an open or closed state of the opening and closing member.

4. The banknote processing apparatus of claim 1, wherein:

the payout controller uses the banknote temporary holding section, or one of the one or more banknote storage boxes as a temporary holding destination for temporarily holding banknotes; and further comprising a temporary holding destination selection section that selects the banknote temporary holding section or one of the banknote storage boxes as the temporary holding destination when the payout controller is feeding out of the detected banknote.

5. The banknote processing apparatus of claim 4, wherein:

the temporary holding destination selection section reselects the temporary holding destination when there is no longer any spare banknote storing capacity in the temporary holding destination that has been firstly selected.

6. A banknote processing method for a banknote processing apparatus comprising one or more banknote storage boxes that store banknotes, a banknote pay-in/pay-out port that receives banknotes inserted by a user, and pays out banknotes to a user, a classification section that classifies at least serial numbers of banknotes, and a banknote temporary holding section, the banknote processing method comprising:

managing banknote management information including a serial number for banknotes respectively stored in the one or more banknote storage boxes;

receiving input of search information including part of, or all of, a serial number of a banknote to be searched for;

searching for a banknote matching the search information based on the banknote management information that is being managed; and feeding out banknotes from one of the one or more banknote storage boxes;

classifying serial numbers of the fed-out banknotes by the classification section;

temporarily storing the fed-out banknotes in the banknote temporary holding section until a banknote with a serial number of the search information is detected;

after the banknote with the serial number of the search information is detected, dispensing the detected banknote to the banknote pay-in/pay-out port; and thereafter returning the fed-out banknotes stored in the banknote temporary holding section to the one of the one or more banknote storage boxes.

* * * * *